United States Patent [19]

Novak et al.

[11] B 4,000,892

[45] Jan. 4, 1977

[54] NOTE STORAGE APPARATUS

[75] Inventors: Frank A. Novak, Seven Hills; Anthony H. Dolejs, Bedford Heights, both of Ohio

[73] Assignee: Ardac, Inc., Willoughby, Ohio

[22] Filed: Jan. 22, 1974

[21] Appl. No.: 435,481

[44] Published under the second Trial Voluntary Protest Program on March 9, 1976 as document No. B 435,481.

[52] U.S. Cl. ..... 271/180; 271/188; 271/215

[51] Int. Cl.[2] ..... B65H 29/46

[58] Field of Search ..... 271/180, 188, 207, 209, 271/214, 215; 209/74 R, DIG. 2

[56] References Cited

UNITED STATES PATENTS

| | | | |
|---|---|---|---|
| 3,655,186 | 4/1972 | Bayha | 271/180 |
| 3,765,523 | 10/1973 | Nakanishi | 209/DIG. 2 X |
| 3,804,266 | 4/1974 | Forthmann | 271/180 X |

*Primary Examiner*—Richard A. Schacher
*Attorney, Agent, or Firm*—Oldham & Oldham Co.

[57] ABSTRACT

A note storage apparatus has a stacking assembly, a push bar assembly movably mounted in the stacker, a coffer assembly for storing the notes, a collector located in the stacker assembly for receiving the notes and the push bar assembly selectively contacting the note and transferring it to the coffer assembly.

25 Claims, 9 Drawing Figures

NOTE STORAGE APPARATUS

BACKGROUND OF THE INVENTION

The present invention relates to a storing apparatus for stacking validated notes. More specifically, the present invention relates to the conveyance and stacking of validated notes.

Heretofore notes such as monetary have commonly been stored in a pile or stacked on top of one another. However, difficulty is encoutered at times in that the note may jam during route from a prior position or station to the storage area such as during the transfer after a validation operation. At other times, the note may not be directed to the storage area but rather hang-up in a portion of the apparatus. Yet another problem often encountered is that the notes are not neatly stacked in the storage area.

SUMMARY OF THE INVENTION

It is therefore an object of the present invention to provide a note storage apparatus which stacks notes in a neat and orderly manner.

It is also an object of the present invention to provide a note storage apparatus which efficiently conveys notes to a stacker for storage.

It is another object of the present invention to provide a note storage apparatus for use with a note validator wherein after validation, the note is transferred to a collector and then transferred into a storage area.

It is a further object of the present invention to provide a note storage apparatus, as above, wherein a motor driven push bar transfers the note into a coffer against a biased urged stack or plate.

It is still another object of the present invention to provide a note storage apparatus, as above, wherein a conveyor transfers the note after validation to the stacker.

These and other objects of the present invention, together with the advantages thereof over existing prior art forms which will become apparent from the following specification, are accomplished by the improvements hereinafter described and claimed.

In general, a note storage apparatus contains a stacker assembly having a collector for receiving the note, a push bar assembly movably mounted in the stacker, and a coffer assembly wherein said push bar assembly selectively contacts the note and transfers it to the coffer assembly.

DESCRIPTION OF THE PREFERRED EMBODIMENT

Figure 1:
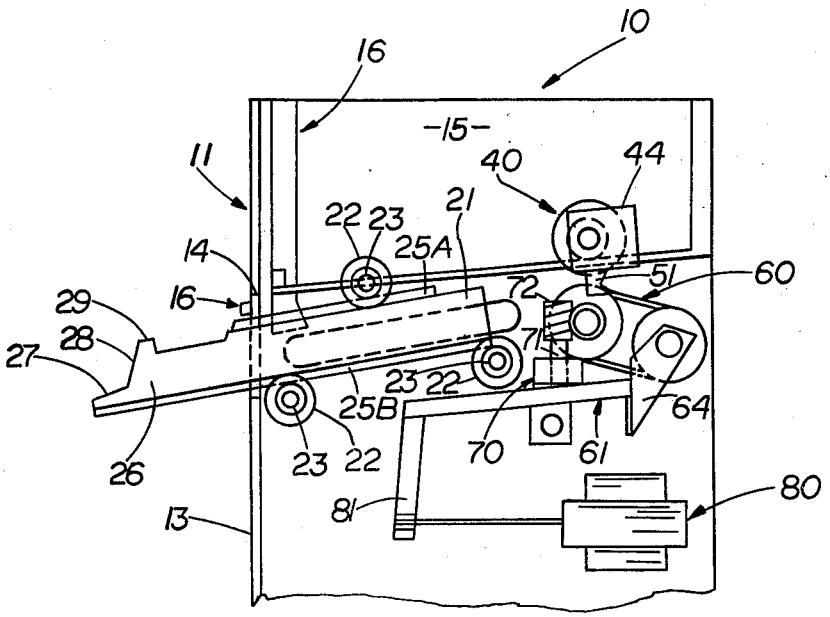
FIG. 1 is a side elevation view of a paper note validator tray.

In general, a note storage apparatus according to the concepts of the present invention is generally indicatd by the numeral 10. Generally, this apparatus comprises a note validating portion generally indicated by the numeral 11 and a note storage portion generally indicated by the numeral 12. Considering the validator portion 11, it contains a housing 13 which is preferably made of steel and usually resides within the framework of a so-called vending or validation machine, not shown. The front of the housing contains a slot or aperture 14 through which extends a tray, generally indicated by the numeral 20 and an escutcheon generally indicated by the numeral 16 also resides within aperture 14.

The escutcheon 16 and tray 20 may be identical or very similar to the device described in a commonly owned pending patent application bearing Ser. No. 374,073 filed June 27, 1973. Briefly, the escutcheon 16 is located in aperture 14 above the tray and is mounted in position by any conventional fastening member to sides 15 of the housing to prevent removal through tampering. Moreover, the escutcheon is located in juxtaposition to tray 20 in a fairly close relationship such that the gap or distance between the two elements is approximately sufficient to accommodate the note. In the preferred embodiment of the present invention, the note is a monetary note although other notes such as legal documents, receipts, checks and the like may also be used.

Referring to tray 20, it has side beams 21 which may engage any conventional guide or tracking member. In the present embodiment, the track members are nylon wheels 22 which are mounted on shafts 23 attached to housing sides 15. The upper side and lower side of the beams have extending rails **25*a* and 25*b* respectively which extend substantially along the beam length and engage slots or grooves in wheels 22. As seen in FIG. 1, the front or push bar portion 26 of tray 20 is designed to accommodate a person's fingers in that it has a horizontally inclined arrest surface 27 and a vertically inclined or push surface 28. Top surface 29 of the tray push bar exists at an elevation so that upon closure of the tray into housing aperture 12,** a narrow gap is left. Preferably, the gap is very small such that a metal coat hanger or other fine wire cannot be inserted into it. This feature prevents tampering such as by withdrawing the note once it has been inserted as in a monetary note-coin changer apparatus.

Figure 2:
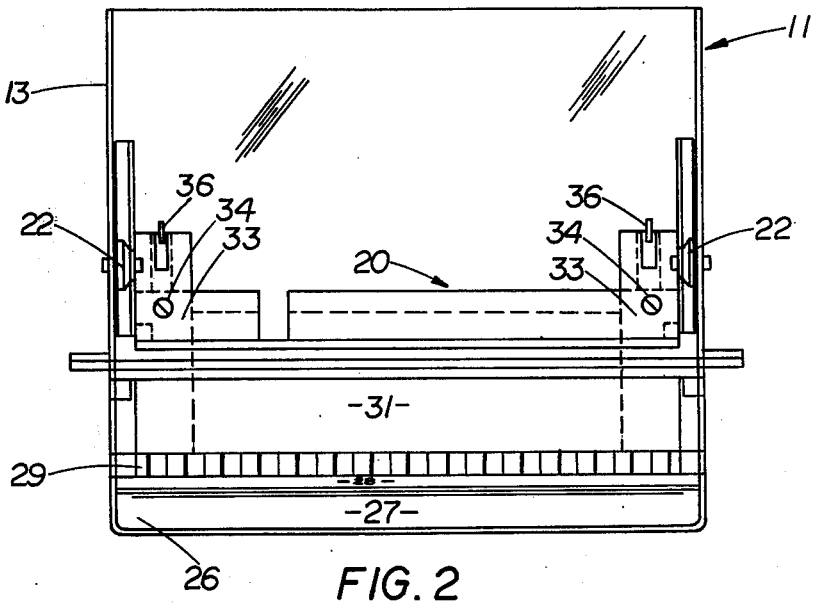
FIG. 2 is a top elevation view of the tray.
Figure 3:
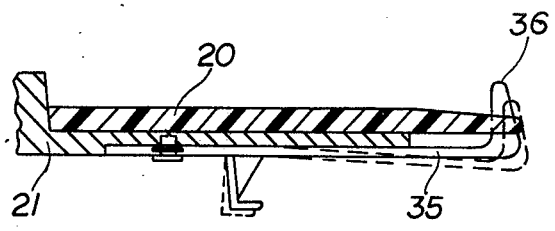
FIG. 3 is a cross sectional view of the note tray.

As seen in FIG. 2, tray note support 31 desirably made of clear plastic may have imprinted upon it in the preferred embodiment the replica of the monetary bill such as a United States One Dollar Federal Reserve Note. The tray note support is attached to generally inward extending beam flange 33 by any conventional fastening means such as screws 34. The note support which generally extends across the entire width of the tray can be removed and another note support inserted which will accommodate a different document note or a smaller sized note as by having sidewalls (not shown) which extend further inwardly. Thus the validator can be used for many different sizes of currency as well as legal documents. To insure that the note is inserted a proper distance into the receptacle, stops 35 of plastic tabs 36 are located on the beam flange 33 at a predetermined distance and secured to the beams by any conventional fastening member.

Figure 4:
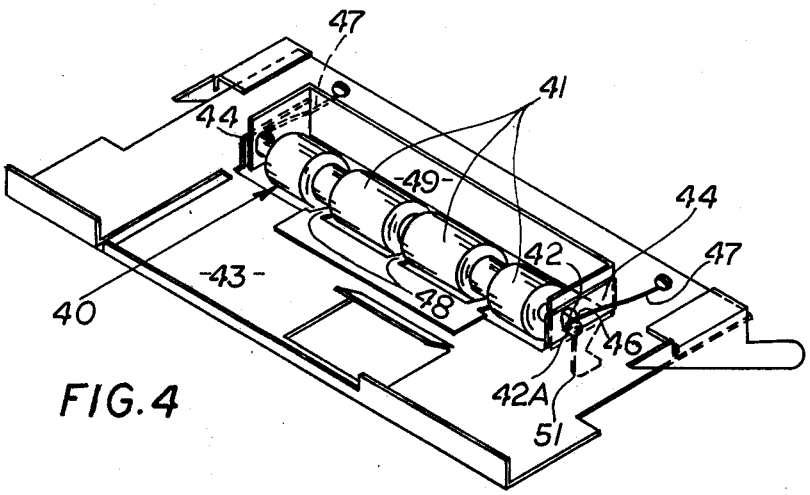
FIG. 4 is a perspective view of a friction roller.

As seen in FIG. 1, note validator 11 contains a frictional roller generally indicated by the numeral 40. Roller 40 contains a series of rolls 41 which preferably are connected together and may be made from a single cylindrical piece of material. Preferably, the rolls are made of a highly frictional material such as rubber and have a rough surface. Shaft 42 of roller 40 is mounted to a support plate 43 in any conventional manner such as through support plate tabs 44. Preferably, support plate 43 is attached to the housing as by having one end of the plate engaging projections of a back surface of escutcheon 16 and the other end being secured to housing sidewalls 15 through conventional fasteners to insure that frictional roller 40 bears against the note. Shaft bearings 42A are located within a slot 46 of the support plate and urged in a downward direction as by springs 47. As shown in FIG. 4, springs 47 may simply be a cantilevered wire attached at one end to plate 43 as by screws in such a manner that it exerts a bias or spring force upon bearing shaft 42. Also connected to support plate 43 are cantilevers 48 which prevent retraction of the note. In addition to this security feature, cantilevers 48, which are preferably made of a resilient smooth material such as metal or plastic, apply a force to the note and cause it to bear against frictional conveyor roller 60 whereupon it is conveyed to a stacker.

In order to prevent removal of a note once it has been validated and has passed through a frictional roller, a gravitational operated bar 49 having dog leg 51 dependent therefrom is mounted on shaft 42 (FIG. 4). Bar 49 will be caused to elevate as the note passes under frictional roller 40 and will drop downwardly thereby exposing dog leg 51 and the path of note travel once the note has completely passed the frictional roller. This added security facet insures that the note may not be retracted as by a wire attached to a portion thereof after the note has been validated and passed to the note storage portion of apparatus 10. Moreover, as bar 49 and dog leg 51 are elevated, the dog leg trips a switch which upon downward movement once the note has passed, initiates a vend signal or pulse which commences operation of the stacker motor 110.

Figure 5:
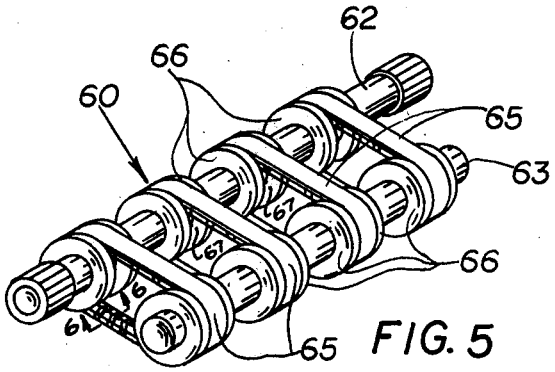
FIG. 5 is a perspective view of a conveyor system.
Figure 6:
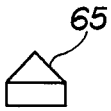
FIG. 6 is a cross sectional view of the V-belt taken on line 6—6 of FIG. 5.

A conveyor roller, generally indicated by the numeral 60, is mounted upon a pivot plate, generally indicated by the numeral 61, such that it is juxtaposition to a note when tray 20 is fully pushed inwardly into receptacle 11. Conveyor 60 comprises a forward shaft 62 and a rearward shaft 63 which are attached to pivot plate 61 in any conventional manner as through tabs 64. Although the conveyor 60 may be continuous, in the preferred embodiment it comprises a series of drive belts 65 which are mounted about shafts 62 and 63. As seen in FIG. 5, both the forward and rearward shafts may contain a plurality of disks 66 which contain a slot or groove 67 therein. The drive belts may be V-belts as shown in FIG. 6 and are of such a length so that sufficient engagement exists between the sides of the belt and the disk to cause them to move in unison. That is, preferably the tension placed on shafts 62 and 63 by the drive belt is very little and only sufficient so as to cause a frictional engagement.

A conventional electric motor, generally indicated by the numeral 70 causes forward shaft 62 to rotate via motor shaft 71 having helical drive gear 72 which engages forward shaft gear 73. The other end of forward shaft 62 has a helical gear which rotates idler shaft 75.

As seen in FIG. 1, a solenoid generally indicated by the numeral 80 is connected to lever 81 which depends from generally the forward and pivot plate 61. The solenoid is activated upon fully depressing note tray 20 which causes the rear portion of tray side beam 21 to trip a switch, not shown, which activates the solenoid as well as motor 70. This causes plate 61 to pivot and move conveyor 60 upwardly. Since conveyor 60 is positioned beneath the rear edge of the paper note, the note will be pinched between conveyor 60 and frictional roller 40. Accordingly, it will be conveyed along the frictional belt conveyor and then into the storage portion of the apparatus.

Figure 7:
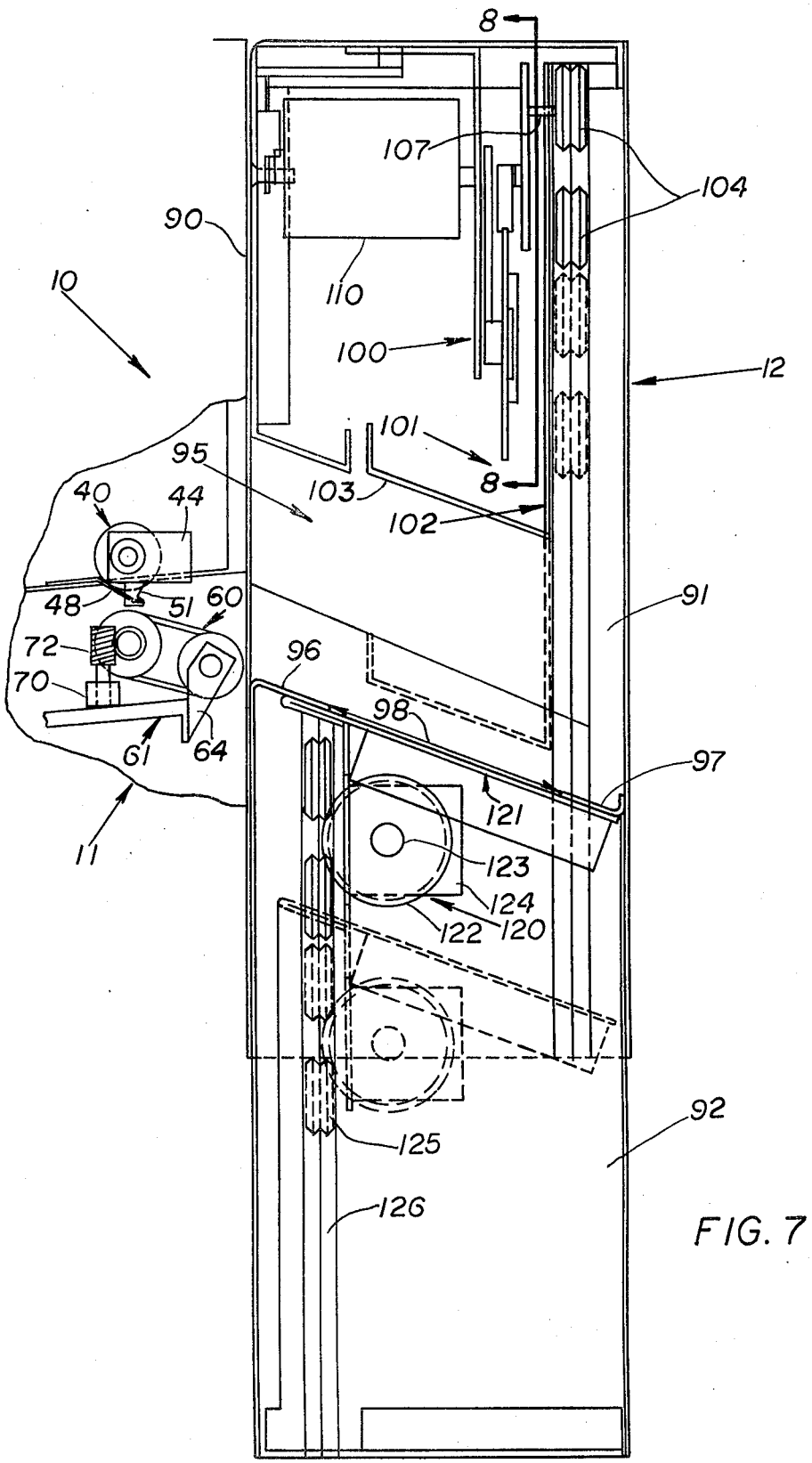
FIG. 7 is a side elevation view of a paper note stacker according to the concepts of the present invention.

Referring now to FIG. 7, the storage portion of the apparatus is a stacker indicated by the numeral 90, The stacker may have an upper housing 91 and a lower housing 92. Upper housing 91 may encase or fit over a portion of lower housing 92 and the two housing units may be connected in any manner for quick detachment such as by the upper housing having a spring clip 93 with an aperture therein which matingly engages a projection 94 of the lower housing. A hopper, generally indicated by the numeral 95, is positioned within the stacker assembly to receive notes from the validator receptacle via frictional roller 40 and conveyor 60. Hopper 95 has a front lip 96 which may be made from the upper edge of lower housing 92 and a rear lip 97 which may be made from a lower edge of upper housing 91. A fairly large gap indicated by the arrow 98 generally exists between the lips. Preferably, the portion of the collector which receives the notes is inclined at approximately 10° to 40° with respect to the horizontal or an optimum angle of about 20° for U.S. currency to allow efficient and facile operation of the stacker. Otherwise, too small of an angle tends to prevent the notes from fully seating on collector lips 96,97 while too large of an angle discourages proper stacking on multiple notes. Moreover, should a note have a torn edge or "dog ear", the inclination of the collector affords a larger space to reduce dog ear hang-ups or jamming. Additionally, stacker 90 contains a push bar assembly generally indicated by the numeral 100 and a coffer assembly generally indicated by the numeral 120.

Figure 9:
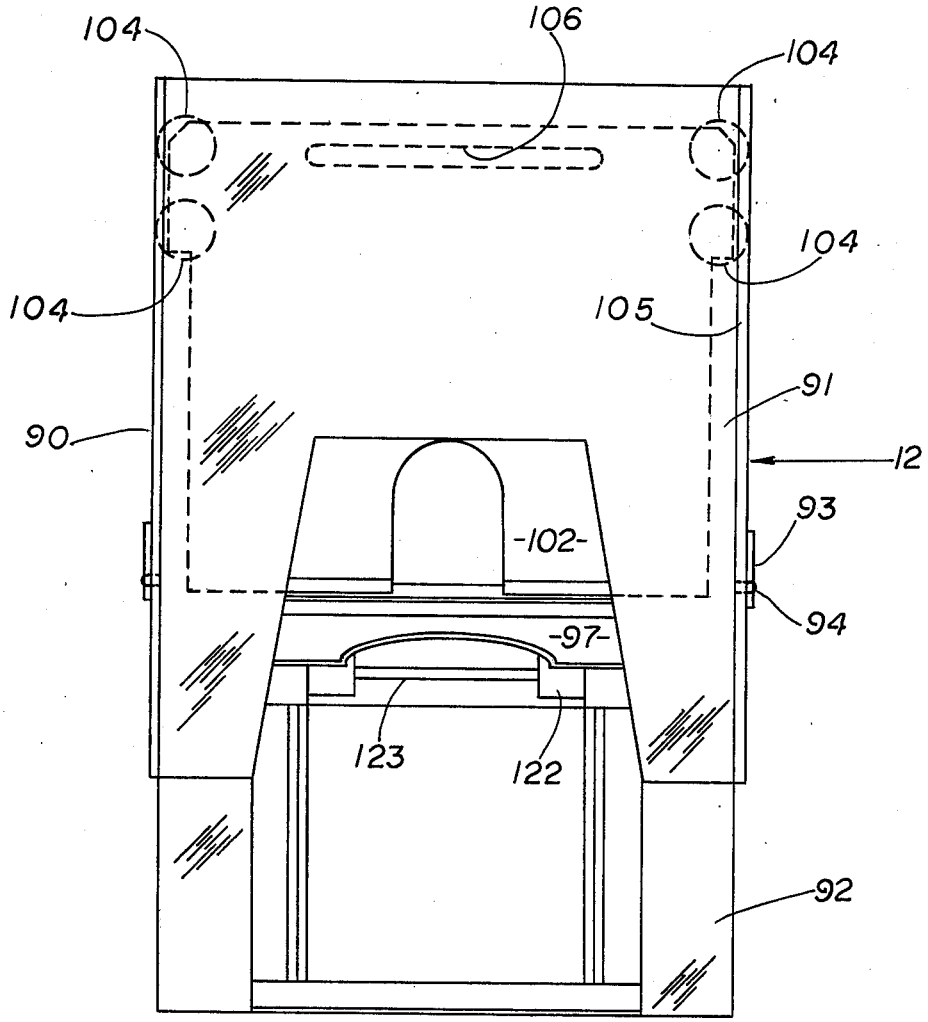
FIG. 9 is a back view of the note stacker.
Figure 8:
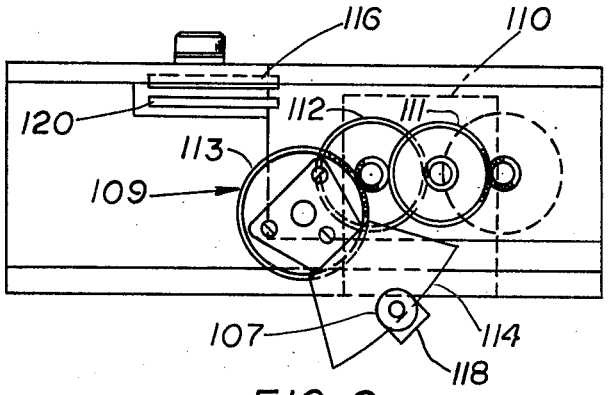
FIG. 8 is an elevational view taken on line 8—8 of FIG. 7.

Considering push bar assembly 100, it may be located at the top of upper housing 91 and contains a push bar plate generally indicated by the numeral 101. The push bar plate has a side portion 102 and a base portion 103 which is designed to extend through the gap 98 when push bar plate 101 is lowered. The push bar plate may be movably mounted in upper housing 91 as through laterally located wheels or disks 104 which preferably may be made of nylon. A groove 105 exists within the side portions of the upper housing and matingly engages wheels 104 to provide a trackway for the push bar plate assembly. As shown in phantom in FIG. 9, push bar plate 101 contains a longitudinal extending groove 106 which engages the drive cam 107 of a drive assembly generally indicated by the numeral 109. As seen in FIG. 8, the drive assembly contains a motor 110 which through idler reduction gears 111 and 112 causes drive gear 113 to rotate. Attached to the drive gear is arm 114 which carries drive cam 107. Hence, upon actuation of drive assembly 109, drive gear 113 through arm 114 and drive cam 107, causes push bar plate 101 to be lowered and raised or reciprocate.

Considering now coffer assembly generally indicated by the numeral 120, it contains a coffer plate generally indicated by the numeral 121 which is urged into bias engagement with front and rear lips 96 and 97. In the particular embodiment disclosed herein, the bias engagement is obtained through a pair of constant force coil springs 122 which are mounted on stacker shaft 123 and attached to lower housing 92. Constant force coil springs are desirable in this invention since as the coffer is filled with notes undue strain or tension is not placed on push bar motor 110. Shaft 123 is attached to coffer assembly 120 in any conventional manner as through tabs 124 which may be punched out from a portion of the assembly.

The coffer assembly is mounted in lower housing 92 by wheels 125 having a concave end portion which ride in lower housing projection 126. Upon pressure being exerted on coffer plate 121, constant force coil springs 122 will yield and unwind causing the assembly to be lowered to a position as shown in phantom.

The operation of the coffer is as follows. In a manner as heretofore described, a note is ejected into hopper 95. Through any conventional switching network which emits a vend pulse upon multiple validation tests of the note, the drive assembly motor is activated for a complete storage cycle of push bar assembly 100. Upon activation of the drive switch, motor 110 causes drive gear 113 to rotate and through drive cam 107 which rides in push bar plate 106 to lower the push bar plate. Upon the downward movement, the push bar base engages the note and continues exerted downward pressure causing coffer plate 121 to be lowered against the constant tension of coiled springs 122. The downward movement or stroke of push bar assembly 100 is sufficient such that the edges of a note are pushed downwardly beneath forward and rearward lips 96 and 97 to the position shown by phantom lines in FIG. 7. As drive gear 113 continues to rotate, the push bar assembly is returned to its elevated position within upper housing 91 whereas the tension in coil springs 122 urges the note upwardly against the underside of front and rear lips 96, 97. In such a manner, additional notes are stored on coffer plate 121 in bias relationship against the lips. After a sufficient amount of notes have been accumulated, they may be readily removed as by urging spring clips 93 outwardly and raising the upper housing 91 to a level sufficient to permit the notes to be pulled outwardly or to the rear of the coffer assembly for facile removal.

The cycle of push bar assembly 100 is governed by push bar switch 116. When push bar assembly 100 is in a normal retracted position as shown by the solid lines in FIG. 7, finger 118 of arm 114 is in a vertical or upward position. When the previously noted vend impulse signal is emitted over a short period of time, it initiates motor 110 causing drive assembly 109 and drive gear 113 to rotate a sufficient distance such that finger 118 moves past switch 116 which is thereby activated. That is, switch 116 is a cam actuated holding circuit which causes motor 110 to continue to operate after the vend impulse operates the motor for a short but sufficient amount of time to cause finger 118 to rotate past switch 116. Switch 116 continues to rotate drive gear 113 until finger 118 rotates approximately 360° and depresses switch 116 causing it to shut-off. Thus, push bar assembly 100 completes a full storage cycle and transfers the note to coffer 120. Moreover, another switch 120 is actuated in any conventional manner by the impulse signal in case of failure of the validating apparatus so that the source of current to motor 110 and conveyor system 60 is terminated after a complete push bar cycle. This insures that additional notes are not accepted when a breakdown occurs in the validator portion of the apparatus.

It should thus be evident that a note storage apparatus according to the concepts of the present invention, as described herein, accomplishes the aforementioned objectives. While according to the Patent Statutes, the best mode and preferred embodiment has been set forth, it will become apparent to those skilled in the art that many other modifications can be made without departing from the spirit of the invention herein disclosed and described; the scope of the invention being limited solely to the scope of the attached claims.

What is claimed is:

1. A note storage apparatus, comprising:
a stacker assembly,
a collector located in said stacker assembly for receiving the note,
a push bar assembly movably mounted for rolling guided contact in said stacker,
a coffer assembly located in said stacker, and
said push bar assembly selectively contacting the note and transferring it to said coffer assembly.

2. A note storage apparatus according to claim 1, wherein said coffer assembly is movably and biasedly urged against said collector so that said transfer note is stored in said coffer assembly and biasedly urged against said coffer assembly.

3. A note storage apparatus according to claim 2, wherein said coffer assembly has a plate and a constant force spring biasedly urges said plate against said collector.

4. A note storage apparatus according to claim 3, wherein said constant force spring is a coil spring.

5. A note spring apparatus according to claim 1, wherein said coffer has a front lip and a rear lip.

6. A note storage apparatus according to claim 1, wherein said push bar assembly has a base plate.

7. A note storage apparatus according to claim 6, wherein the rolling guided contact of said push bar assembly comprises wheels and said wheels ride in a trackway located in said stacker.

8. A note storagee apparatus according to claim 7, wherein said wheels are laterally located on said push bar assembly and said trackway is a groove in said stacker.

9. A note storage apparatus according to claim 6, wherein a motor selectively drives said push bar assembly downwardly so that said base plate transfers said note into said coffer assembly.

10. A note storage apparatus according to claim 6, wherein said collector has a front lip and a rear lip and said coffer assembly is movably and biasedly urged against said lips by a spring.

11. A note storage apparatus according to claim 10, wherein the downward stroke length of said push bar assembly is sufficient to push the edges of the note downwardly beneath said front and rear collector lips and into said movably and biasedly mounted coffer assembly.

12. A note storage apparatus according to claim 9, wherein said push bar assembly has a side plate, said side plate has a groove, a cam engages said groove, a motor connected to said cam so that upon activation of said motor, said push bar assembly reciprocates.

13. A note storage apparatus according to claim 1, wherein said stacker has an upper and a lower housing.

14. A note storage apparatus according to claim 13, wherein said upper housing contains such push bar assembly and said lower housing contains said coffer assembly.

15. A note storage apparatus according to claim 13, wherein said upper housing releaseably engages said lower housing.

16. A note storage apparatus according to claim 15, wherein said lower housing has a projection and said upper housing has a spring clip which releaseably engages said projection.

17. A note storage apparatus according to claim 1, including means for feeding said note into said collector.

18. A note storage apparatus according to claim 17, wherein said feeding means is a roller assembly.

19. A note storage apparatus according to claim 18, wherein said roller assembly has a forward shaft and a rear shaft and said shafts are connected by a plurality of belts.

20. A note storage apparatus according to claim 19, wherein said belts are V belts.

21. A note storage apparatus according to claim 19, wherein a selectively activated motor is connected to one of said roller shafts so that upon activation the note is conveyed into said collector.

22. A note storage apparatus according to claim 19, including a frictional roller assembly located above said roller assembly.

23. A note storage apparatus according to claim 22, wherein said frictional roller is biasedly urged in a downward direction.

24. A note storage apparatus according to claim 21, including a frictional roller located above said roller assembly, said roller assembly being pivotally mounted, said motor upon activation causing said roller assembly to pivot upwardly against said frictional roller assembly.

25. A note storage apparatus, comprising a stacker assembly, a collector located in said stacker assembly for receiving the note, a push bar assembly movably mounted in said stacker, said push bar assembly having laterally located wheels, said push bar assembly wheels riding in a stacker trackway, a coffer assembly having a note plate, said coffer assembly located in said stacker, said coffer note plate movably connected to a constant force spring, and said push bar assembly having a stroke sufficient to contact the note in the collector and push the note into said coffer assembly against said coffer plate.

* * * * *